US005957100A

United States Patent [19]

Frohwerk et al.

[11] Patent Number: 5,957,100

[45] Date of Patent: Sep. 28, 1999

[54] METHOD FOR MANUFACTURING A CYLINDER HEAD COVER FOR A COMBUSTION ENGINE AND A CYLINDER HEAD COVER

[75] Inventors: Ralf Frohwerk, Zarpen; Heike Hohn, Hamburg; Rolf Johnen, Hoisdorf; Klaus Seifert, Frechen, all of Germany

[73] Assignee: Dichtungstechnik G. Bruss GmbH & Co. KG, Germany

[21] Appl. No.: 09/026,402

[22] Filed: Feb. 19, 1998

[51] Int. Cl.[6] ..... F02F 7/00

[52] U.S. Cl. ..... 123/90.38; 123/90.37; 156/272.6; 427/536; 29/888.01; 277/598

[58] Field of Search ..... 123/90.33, 90.37, 123/90.38, 195 C, 198 E; 156/272.6, 275.7; 427/535, 539, 536; 29/888.01; 277/592, 598

[56] References Cited

U.S. PATENT DOCUMENTS

| | | | |
|---|---|---|---|
| 3,692,335 | 9/1972 | Vickers et al. | 285/49 |
| 5,108,780 | 4/1992 | Pitt et al. | 427/538 |
| 5,323,740 | 6/1994 | Daily et al. | 123/90.38 |
| 5,364,109 | 11/1994 | Sihon | 277/9 |
| 5,375,569 | 12/1994 | Santella | 123/90.38 |
| 5,511,518 | 4/1996 | Jain et al. | 123/90.37 |
| 5,513,603 | 5/1996 | Ang et al. | 123/90.37 |
| 5,590,887 | 1/1997 | Senda et al. | 277/205 |

FOREIGN PATENT DOCUMENTS

| | | |
|---|---|---|
| 0070500 | 1/1983 | European Pat. Off. . |
| 0510891 | 10/1992 | European Pat. Off. . |

*Primary Examiner*—Weilun Lo
*Attorney, Agent, or Firm*—Rogers & Killeen

[57] ABSTRACT

A cylinder head cover for a combustion engine having a cover member (2) and a seal (4) made of an elastomer, which includes a metallic stiffener (8) and which serves for sealing with respect to the cover member (2) and a cylinder head surface (12) is characterized in that the cover member (2) is made of plastics and that the cover member (2) and the seal (4) are joined to a prefabricated unit after a corona treatment of the surface (5) of the seal (4) opposite the cover member (2) and adhesion by means of an adhesive.

16 Claims, 1 Drawing Sheet

METHOD FOR MANUFACTURING A CYLINDER HEAD COVER FOR A COMBUSTION ENGINE AND A CYLINDER HEAD COVER

The invention refers to a method for manufacturing a cylinder head cover for a combustion engine.

Cylinder head covers of today's combustion engines have to be well sealed on the cylinder head and have to be mounted decoupled from structure-borne noise as much as possible. For this purpose, solutions with separated cover designs are known, in which two cover members made of metal sheet or light metal diecasting are joined by means of molded-on rubber, which establish a noise-decoupled connection between the two cover members (U.S. Pat. No. 3,692,335). At the same time, this rubber can also be formed to provide a seal with respect to the worked cylinder head surface (DE 26 38 982). These known solutions were not accepted in practice.

In a solution of today's practice, an elastomer seal provided with compression limiters in the form of metallic sleeves is inserted between an attachment flange of the cylinder head cover formed of light metal diecasting or deep-drawn sheet metal, wherein said sleeves are passed by fixing screws which fasten the attachment flange of the cylinder head cover through the elastomer seal at the cylinder head surface. In this case, the seal is provided as a prefabricated , separate member. The seal except for the sleeve-shaped press limiters also includes a frame-like metal stiffer for reinforcement. Regarding the manufacturing costs and the tightness, this solution is satisfactory, but is not satisfactory regarding the noise decoupling.

Cylinder head covers made of plastics have been used recently for reasons of weight reduction. There, a seal is separately clamped between the attachment flange of the cylinder head cover and the cylinder head surface as is the case in the above described case. In plastic covers of that kind it turned out to be problematic, in that the covers tend to "set" during operation caused by their material, which influences tightness. Thus, plastic covers of that kind are manufactured with incorporated metallic fixing sleeves which prevent disadvantageous effects of setting during attachment. This, however, increases the cost of manufacturing the plastic cover.

Thus, the object of the invention is to create a method for manufacturing a cylinder head cover as well as a cylinder head cover of the above-mentioned kind which is satisfactory regarding the manufacturing costs, sealing and noise decoupling properties.

Advantageous embodiments of the invention are defined in the claims and subclaims.

The invention provides a direct, durable and tight connection between the elastomer of the seal and the plastic material of the cylinder head cover by means of adhesion and preceding corona treatment of at least one of the surfaces to be connected, as has been used for many years in the print industry for printing on plastic surfaces (cf. "Vorbehandlung von Kunststoffoberflächen füur Bedruckung und Kennzeichnung" of M. Theiwes, company's magazine of the company ARCOTEC Oberflächentechnik GmbH, December 1996). After such a corona treatment, the prefabricated elastomer seal according to the invention having incorporated metallic stiffeners can directly be permanently attached to the cover plastic member. To prepare the adhesion a high frequency corona treatment of the surface of the seal, to be connected with the cover member by integrating the prefabricated elastomer seal between an electrode and a counter electrode by intensive electron bombardment of this elastomer surface, is advantageously carried out to thereby activate said surface of the seal for preparing for adhesion with the cover.

In the cylinder head cover according to the invention, the fixing screws for connecting the cylinder head cover with the cylinder head preferably engage directly at the metallic frame. In an advantageous manner, rib-like projections of the elastomer portion of the seal are pressed flat against the planar cylinder head surface, wherein these projections are preferably located within the screw force points of pressure. This achieves a high sealing effect and at the same time a excellent noise decoupling and noise attenuation.

The invention will now be described with reference to diagrammatic drawings showing two preferred embodiments.

Figure 1:
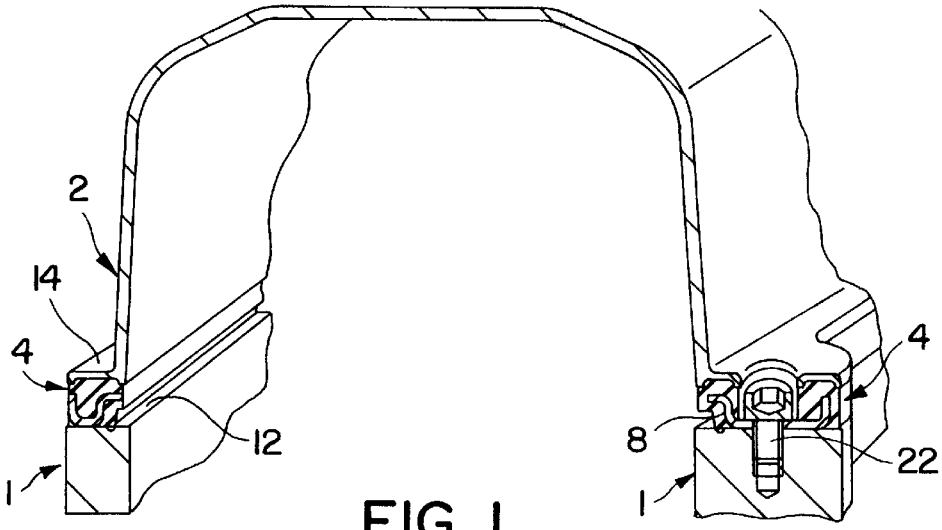
FIG. 1 is a cross section through a perspectively shown upper end portion of a cylinder head with a cylinder head cover mounted thereon according to the invention.

FIG. 1 schematically shows a section through a cylinder head cover 2, 4 in a condition mounted on a cylinder head housing 1. The positions at which the cylinder head cover 2, 4 sealingly contact the cylinder head surface 12, are shown in enlarged scale in FIGS. 2 and 3, wherein FIG. 3 is drawn at an 180° offset compared to FIG. 1.

Figure 2:
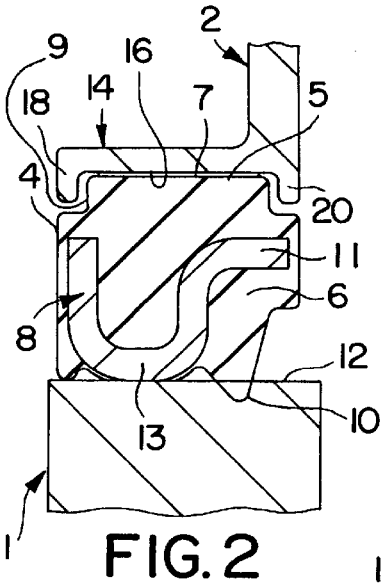
FIGS. 2 and 3 are enlarged detail sections at the left or right attachment positions of cover and seal of FIG. 1.
Figure 3:
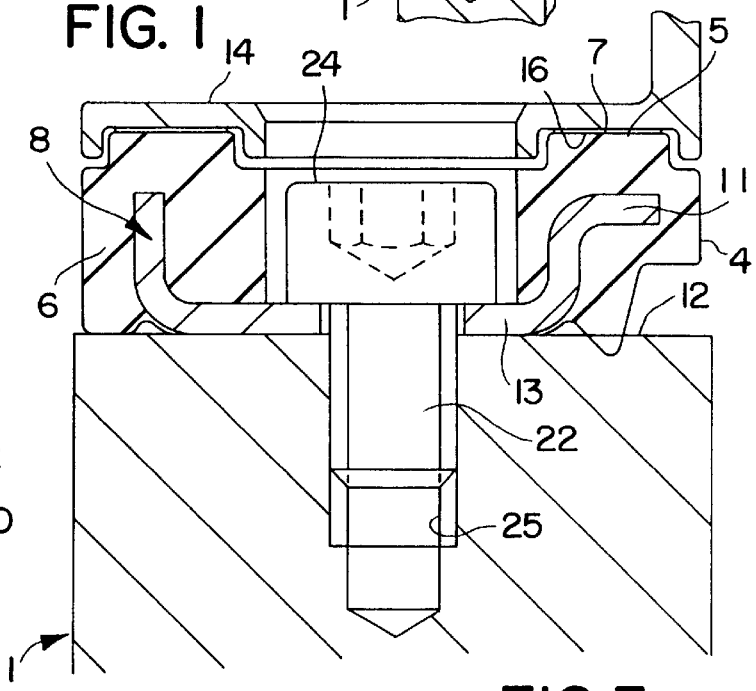

In FIGS. 2 and 3 the details can be recognized much clearer. Reference numeral 2 designates a cover member made of a shock-resistant plastic material. Reference numeral 4 designates a prefabricated elastomer seal, wherein a C-shaped metal frame 8 having a substantially C-shaped cross section is integrated into the elastomer material 6 of this elastomer seal. The seal 4 has a rib-like projection 10 on its side facing the cylinder head surface 12, said projection being shown in un-shaped condition in FIGS. 2 and 3, which, however, in assembled condition is actually flatly pressed to the cylinder head surface 12, so that a pressure tip is formed at the position below the tip of the projection 10.

The cylinder head cover 2 has a flange 14, the lower side 16 of which facing the upper side 5 of the seal 4. On this upper side 5, the elastomer of the seal 4 is activated by means of HF corona treatment and adhered to the lower side 16 of the flange 14 by means of a suitable adhesive.

The flange 14 has claws 18, 20 projecting at both sides, by means of which the flange encloses the upper portion 9 of the seal 4 stepped at both sides.

The C-profile of the metal frame 8 is provided with a bend 11 which extends parallel to the cylinder head surface 12.

In the area of screws 22 for removably connecting the cylinder head cover 2, 4 with the cylinder head housing, the fixing flange 14 as well as the elastomer seal 4 are enlarged (see the perspective view in FIG. 1 and FIG. 3). The metallic frame 8 is passed in this area by a screw throughbore, and the seal 4 as well as the fixing flange 14 are passed by larger throughbores for passing the head 24 of the screw 22.

The metallic frame 8 having a C-shaped profile defines the deformability of the elastomer material 6 of the seal 4 in the direction perpendicular to the cylinder head surface 12.

The cylinder head cover is manufactured according to the invention as follows:

First of all, the cover member 2 made of a shock-resistant plastic material and the fixing flange 14 are formed in a conventional manner, e.g. in an injection molding process.

Independent thereof, the seal 4 with the integrated metallic frame 8 is manufactured by vulcanizing the elastomer material 6 in a mold. The seal 4 then has the shape according to FIGS. 1 to 3.

Subsequently, the elastomer surface 5 of the seal 4 facing the lower side 16 of the fixing flange 14 is corona-treated in a radio frequency method, wherein the seal is located between an electrode and a grounded counter electrode. The counter electrode in this case may be the metallic frame 8. During the corona treatment, the elastomer surface 5 of the seal 4 is bombarded with electrons at high frequency (25 to 50 kHz). Due to the intensive bombardment, the molecular chains in surface 5 are broken. Charged ions deposit at the spots of rupture at which molecules of a suitable adhesive can deposit. For corona treatment, it is mostly sufficient to overroll the elastomer surface 5 many times with a simple roller electrode. In mass production, a plurality of such roller electrodes can be used simultaneously, which reduces the treatment time to few seconds.

After corona treatment, the adhesive is applied in the form of a bead onto the upper side 5 of the seal 4 and/or the lower side 16 of the fixing flange 14 of the cover member 2. Then, cover member 2 and seal 4 are inserted into a heatable, pre-heated adhesion apparatus (not shown), in which the members in adhesion position are held in closed condition for a predetermined dwelling time on a predetermined curing temperature. During early tests, the dwelling time was 15 minutes and the curing temperature was 180° C. Then the adhesion apparatus is opened and the ready cylinder head cover 2, 4 with a seal fixedly adhered to the cover member 2 is removed from the adhesion apparatus.

During subsequent mounting of the cylinder head cover 2, 4 at the cylinder head housing 1, the screws 22 are inserted through the screw holes in the seal 4 provided at regular distances and connected by screwing to the associated thread holes 25 in the cylinder head. The screw heads 24 engage with their lower side the web 13 of the C-shaped frame 8 and press the seal 4 through this web 13 directly to the cylinder head surface 12. The pressure force generated thereby presses flat the rib-like projections 10 of the elastomer seal 4, so that a durable, leakage-free sealing effect is achieved.

A favorable noise de-coupling is on one hand achieved by the selection of a suitable plastic material as material of the cover member 2 and on the other hand by the direct adhesion of the cover member 2 with the elastomer of the seal 4 without interconnection of sound-transmitting metallic elements.

Figure 4:
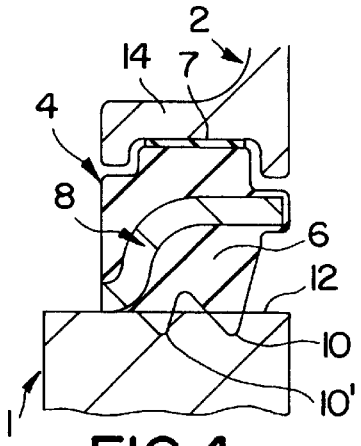
FIGS. 4 and 5 show detail sections according to FIG. 2 and 3 of a modified embodiment of a cylinder head cover according to the invention.
Figure 5:
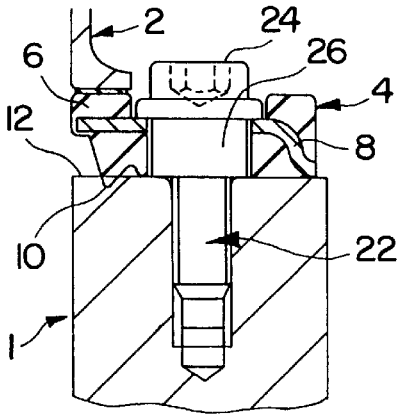

For the modified embodiment, FIGS. 4 and 5 show the two connection portions left and right analogously to FIG. 1 between the cylinder head cover 2, 4 and the cylinder head housing 1, wherein equal or equal acting members are indicated by the same reference numerals for reasons of simplicity.

In contrast to the statements made with respect to FIG. 2 and 3, the metallic frame 8 has an S-shaped cross section and only a limited portion thereof outside the screw connection directly contacts the cylinder head surface 12. The distance between the cylinder head surface 12 and the screw head 24 is bridged in this embodiment by a collar section 26 of the screw 22.

A further difference is that outside of the portion for passing the screw shaft and the collar section 26, the seal 4 is provided with two elastomer projections 10, 10' on the side of the cylinder head surface 12, said projections in this case being shown undeformed. In assembled condition, they are, however, pressed flat against the cylinder head surface 12. Thereby, a graded sealing effect is achieved.

Preferred materials for manufacturing the cover member 2 are polyamide (PA 6,6) or polyphenylen (PPS) with fiber glass reinforcement and/or mineralic filling.

As an elastomer material of the sealing 4, acrylate caoutchouc (ACM), ethylene acrylate caoutchouc (AEM) or fluor caoutchouc (FPM) are used.

The frame 8 is preferably extruded from steel sheet and punched, or made as a diecast part of a light metal alloy, in particular an Al alloy.

The features disclosed in the above description, the Figures and the claims, are meaningful for the realization of the invention either individually or in any combination with one another.

We claim:

1. A method for manufacturing a cylinder head cover for a combustion engine having a cover member (2) and a seal (4) made of an elastomer (6), which includes a stiffener (8) and which serves for sealing with respect to a cylinder head surface (12), characterized by forming the cover member (2) of plastics, activating a surface (5) of the seal (4) opposite the cover member by corona treatment, applying an adhesive (7) onto the activated surface (5) of the seal and/or onto a counter surface (16) of the cover member (2), inserting the cover member (2) and the seal (4) into a heatable, preheated adhesion apparatus, holding the adhesion apparatus in closed condition for a predetermined period of time at a predetermined temperature and removing the ready cylinder head cover from the adhesion apparatus.

2. A method according to claim 1, characterized in that surface (16) of the cover member (2) opposite the seal is also activated by corona treatment.

3. A method according to claim 1, characterized in that the corona treatment is a radio frequency treatment.

4. A method according to claim 2, characterized in that the corona treatment is a radio frequency treatment.

5. A cylinder head cover for a combustion engine having a cover member (2) and a seal (4) made of an elastomer, which includes a metallic stiffener (8) and which serves for sealing with respect to the cover member (2) and a cylinder head surface (12), characterized in that the cover member (2) is made of plastics, and the cover member (2) and the seal (4) are joined to form a prefabricated unit by means of a corona treatment of the surface (5) of the seal (4) opposite the cover member, and by adhesion by means of an adhesive.

6. A cylinder head cover according to claim 5, characterized in that the stiffener (8) is formed by a closed frame integrated into the elastomer of the seal, at which fixing screws (22) for removably connecting the cylinder head cover (2, 4) with the cylinder head (1) directly engage.

7. A cylinder head cover according to claim 6, characterized in that the frame (8) has a substantially C-shaped cross section.

8. A cylinder head cover according to claim 7, characterized in that the seal (4) on the side facing the cylinder head (1) comprises at least one rib-like projection (10) which in assembled condition of the cylinder head cover (2, 4) is flatly pressed to the cylinder head surface (12).

9. A cylinder head cover according to claim 4, characterized in that the stiffener comprises a frame of substantially C-shaped cross section.

10. A cylinder head cover according to claim 4, characterized in that the seal (4) on the side facing the cylinder head (1) comprises at least one rib-like projection (10) which in assembled condition of the cylinder head cover (2, 4) is flatly pressed to the cylinder head surface (12).

11. A cylinder head cover according to claim 5, characterized in that the seal (4) on the side facing the cylinder head (1) comprises at least one rib-like projection (10) which in assembled condition of the cylinder head cover (2, 4) is flatly pressed to the cylinder head surface (12).

12. The cylinder head of claim 5 wherein the adhesive requires preheating and compression to effect the adhesion.

13. A method for manufacturing a cylinder head cover for a combustion engine having a cover member (2) and a seal (4) made of an elastomer (6), which includes a stiffener (8) and which serves for sealing with respect to a cylinder head surface (12), characterized by forming the cover member (2) of plastics, activating a surface (5) of the seal (4) opposite the cover member by corona treatment, applying an adhesive (7) onto the activated surface (5) of the seal and/or onto a counter surface (16) of the cover member (2), inserting the cover member (2) and the seal (4) into an adhesion apparatus, holding the adhesion apparatus in closed condition for a predetermined period of time, and removing the ready cylinder head cover from the adhesion apparatus.

14. The method of claim 13 further comprising the step of preheating the adhesion apparatus to a predetermined temperature.

15. A method according to claim 14, characterized in that surface (16) of the cover member (2) opposite the seal is also activated by corona treatment.

16. A method according to claim 14, characterized in that the corona treatment is a radio frequency treatment.

* * * * *

UNITED STATES PATENT AND TRADEMARK OFFICE

CERTIFICATE OF CORRECTION

PATENT NO. : 5,957,100
DATED : September 28, 1999
INVENTOR(S) : Frohwerk et al.

It is certified that error appears in the above-identified patent and that said Letters Patent is hereby corrected as shown below:

Title page,
Item [30], Foreign Priority, please insert -- (EP) 97 102 906 2/21/1997 --.

Signed and Sealed this

Tenth Day of June, 2003

JAMES E. ROGAN
*Director of the United States Patent and Trademark Office*